US011358768B2

(12) United States Patent
Everest et al.

(10) Patent No.: US 11,358,768 B2
(45) Date of Patent: Jun. 14, 2022

(54) SECURING DEVICE

(71) Applicant: SIMPLE STRAP LLC, Honolulu, HI (US)

(72) Inventors: Jonathan F. Everest, Honolulu, HI (US); Cameron Smith, Honolulu, HI (US); Benjamin Komer, Honolulu, HI (US)

(73) Assignee: SIMPLE STRAP LLC, Honolulu, HI (US)

( * ) Notice: Subject to any disclaimer, the term of this patent is extended or adjusted under 35 U.S.C. 154(b) by 0 days.

(21) Appl. No.: 17/195,936

(22) Filed: Mar. 9, 2021

(65) Prior Publication Data

US 2021/0188504 A1 Jun. 24, 2021

Related U.S. Application Data

(63) Continuation-in-part of application No. 16/544,514, filed on Aug. 19, 2019, now Pat. No. 10,954,046.

(60) Provisional application No. 62/768,881, filed on Nov. 17, 2018.

(51) Int. Cl.
*B65D 63/10* (2006.01)

(52) U.S. Cl.
CPC ..... *B65D 63/109* (2013.01)

(58) Field of Classification Search
CPC .. B65D 63/00; B65D 63/109; B65D 63/1009; B65D 63/10; A63B 21/028; A63B 21/0555; A63B 21/0552
See application file for complete search history.

(56) References Cited

U.S. PATENT DOCUMENTS 2,105,881 A 1/1938 Fether
5,503,908 A 4/1996 Faass
(Continued)

FOREIGN PATENT DOCUMENTS

WO WO2015102083 A1 7/2015

OTHER PUBLICATIONS

International Search Report and Written Opinion dated Dec. 30, 2019, in PCT Application Serial No. PCT/US2019/055793.

*Primary Examiner* — Robert Sandy
*Assistant Examiner* — Michael S Lee
(74) *Attorney, Agent, or Firm* — Roeder & Broder LLP; James P. Broder

(57) ABSTRACT

A securing device (10) for securing a first object (320) relative to a second object (322) includes a device body (12) having a cross-sectional area, and which is formed from a material so that the device body (12) exhibits elongation of between six hundred percent and eight hundred percent. A ratio of the elongation (in percent) to the cross-sectional area (in square millimeters) is between approximately 5:1 and 10:1. The device body (12) is also formed from the material so that the device body (12) exhibits a tensile strength of between four thousand five hundred kPa and nine thousand three hundred kPa. A ratio of the tensile strength (in kPa) to the cross-sectional area (in square millimeters) is between approximately 50:1 and 85:1. The material that forms the device body (12) has an average kinetic coefficient of friction of between approximately 1.35 and 1.60 relative to itself. The material that forms the device body (12) can include thermoplastic elastomers, and can further include styrene.

9 Claims, 4 Drawing Sheets

(56) References Cited

U.S. PATENT DOCUMENTS

| | | | | |
|---|---|---|---|---|
| 5,540,714 | A * | 7/1996 | Payne, Jr. ..... | A61B 17/1322 606/201 |
| 5,653,728 | A * | 8/1997 | Ahern ..... | A61B 17/1322 606/203 |
| 5,945,060 | A | 8/1999 | Williams | |
| 6,230,711 | B1 | 5/2001 | Maisnik | |
| 2006/0185059 | A1 | 8/2006 | Taha et al. | |
| 2016/0333158 | A1 | 11/2016 | Ohtani et al. | |

* cited by examiner

SECURING DEVICE

RELATED APPLICATION

The present application is a continuation-in-part application claiming the benefit under 35 U.S.C. 120 on co-pending U.S. patent application Ser. No. 16/544,514, filed on Aug. 19, 2019, and entitled "SECURING DEVICE". Additionally, U.S. patent application Ser. No. 16/544,514 claims priority on U.S. Provisional Application Ser. No. 62/768,881, filed on Nov. 17, 2018, and entitled "SECURING DEVICE". As far as permitted, the contents of U.S. patent application Ser. No. 16/544,514 and U.S. Provisional Application Ser. No. 62/768,881 are incorporated herein by reference.

BACKGROUND

Many different types of securing devices are used to secure a plurality of objects together and/or to inhibit movement of one object relative to another object. Such securing devices can come in the form of ropes, cables, bungee cords, nylon straps, chains, or various other types of tie-downs. Unfortunately, existing securing devices suffer from various drawbacks, including difficulty in finding a securing device of the proper or appropriate size, length and/or strength; difficulty in fixing the position of the securing device relative to the objects to be held in place; and difficulty in removing the securing device after use (such that the securing device becomes damaged during removal and thus is not reusable). Such drawbacks can lead to a user needing to have many securing devices available to accommodate the various situations when such a securing device may be required. Accordingly, it is desired to provide a securing device that is easy and convenient in use for both installation and removal, easily reusable, flexible in use for securing objects of various shapes and sizes, and cost-efficient.

SUMMARY

The present invention is directed toward a securing device for securing a first object relative to a second object. In various embodiments, the securing device includes a device body having a cross-sectional area. The device body is formed from a material so that the device body exhibits elongation of between six hundred percent and eight hundred percent. Additionally, a ratio of the elongation (in percent) to the cross-sectional area (in square millimeters) is between approximately 5:1 and 10:1.

In some embodiments, the cross-sectional area of the device body is between approximately thirty square millimeters and two hundred square millimeters. Additionally, in certain embodiments, the cross-sectional area of the device body is between approximately eighty square millimeters and one hundred twenty square millimeters. Further, in some embodiments, the device body can have a body thickness of between approximately one millimeter and four millimeters. In certain such embodiments, the device body can have a body width of between approximately thirty millimeters and fifty millimeters.

Additionally, in certain embodiments, the material that forms the device body has an average kinetic coefficient of friction of between approximately 1.35 and 1.60 relative to itself.

Further, in some embodiments, the device body is formed from the material so that the device body exhibits tensile strength of between four thousand five hundred kPa and nine thousand three hundred kPa. In such embodiments, a ratio of the tensile strength (in kPa) to the cross-sectional area (in square millimeters) can be between approximately 50:1 and 85:1.

In certain embodiments, the material that forms the device body includes thermoplastic elastomers. Additionally, the material that forms the device body can further include styrene.

In other embodiments, the present invention is directed toward a securing device for securing a first object relative to a second object, the securing device including a device body having a cross-sectional area, the device body being formed from a material so that the device body exhibits tensile strength of between four thousand five hundred kPa and nine thousand three hundred kPa; wherein a ratio of the tensile strength (in kPa) to the cross-sectional area (in square millimeters) is between approximately 50:1 and 85:1.

Additionally, in still other embodiments, the present invention is directed toward a securing device for securing a first object relative to a second object, the securing device including a device body having a body thickness of between approximately one millimeter and four millimeters, a body width of between approximately thirty millimeters and fifty millimeters, and a cross-sectional area of between approximately thirty square millimeters and one hundred twenty square millimeters, the device body being formed from a material including thermoplastic elastomers so that the device body exhibits elongation of between six hundred percent and eight hundred percent, and so that the device body exhibits tensile strength of between four thousand five hundred kPa and nine thousand three hundred kPa; wherein a ratio of the elongation (in percent) to the cross-sectional area (in square millimeters) is between approximately 5:1 and 10:1; wherein a ratio of the tensile strength (in kPa) to the cross-sectional area (in square millimeters) is between approximately 50:1 and 85:1; and wherein the material that forms the device body has an average kinetic coefficient of friction of between approximately 1.35 and 1.60 relative to itself.

The present invention is further directed toward a method for securing a first object relative to a second object.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
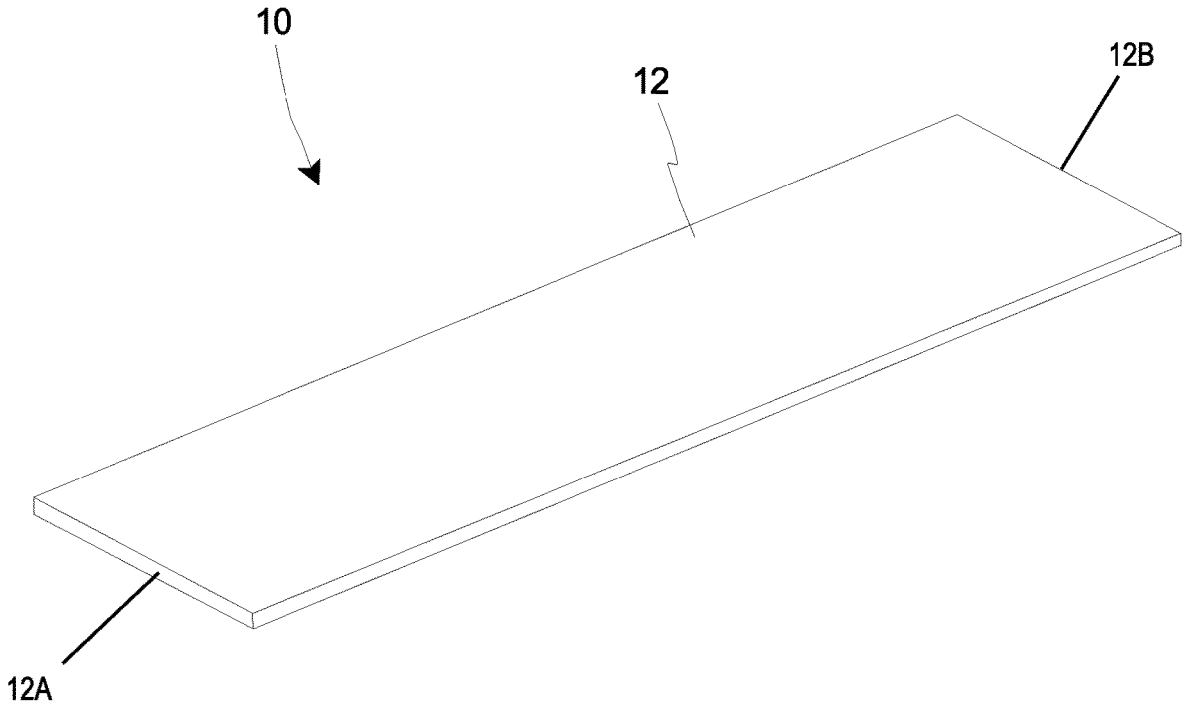
FIG. 1 is a simplified schematic perspective view illustration of an embodiment of a securing device having features of the present invention.

Embodiments of the present invention are described herein in the context of a securing device that is usable by a user for the general purpose of securing a first object relative to a second object. For example, the securing device can be used by the user for quickly and easily securing, binding and/or tying down a plurality of objects together, and/or for inhibiting movement of the first object relative to the second object. More specifically, in various embodiments, the securing device can be easily provided in varying lengths so as to properly and effectively secure objects of various sizes and shapes, is easy and convenient to install and remove, and is readily reusable from one securing task to the next. Thus, the securing device of the present invention provides an easy and cost-effective solution to the various securing tasks that the user is likely to encounter. Further, in some embodiments, the securing device can also be recycled and/or repurposed for use in accomplishing other tasks.

Additionally, the securing device as described in detail herein is able to overcome various specific drawbacks that are often experienced with other types of securing devices. For example, (i) unlike ropes or cables, there is no need to tie knots, which can be difficult to secure and/or can be difficult to undo so that the rope or cable may need to be cut to remove the rope or cable, thereby making the rope or cable not reusable; (ii) unlike bungee cords, there are no hooks at either end which are required to secure the cord, and which can be a limiting factor as to whether or not the bungee cord is an appropriate size/length for use on a particular task; (iii) unlike nylon straps, there is no ratchet system required to tighten and secure the strap; and (iv) unlike chains, there is an easy and convenient manner in which the secure the ends, and it is much easier to provide in desired and/or required alternative lengths. Further, as provided herein, the securing device can overcome such drawbacks without the need for any adhesives for purposes of installation, and while being formed from homogeneous material (e.g., without identifiable layers or sections of material).

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

FIG. 1 is a simplified schematic perspective view illustration of an embodiment of a securing device 10 having features of the present invention. As described herein, the securing device 10 of the present invention can be usable for various types of securing tasks, which can be referred to generally as securing (at least) a first object relative to a second object. For example, in certain non-exclusive alternative applications, the securing device 10 can be used for camping or other outdoor leisure activities (e.g., securing tent poles to stakes), for various automotive purposes (e.g., for securing various objects to the roof rack or roof of an automobile), for various construction and/or home improvement projects (e.g., for bundling together lumber, rebar and/or other construction materials), and/or for various transportation functions (e.g., securing loose items of the deck of a boat, or in the cargo-hold of a boat or airplane). Additionally, or in the alternative, the securing device 10 can be used for any other suitable tasks where it is desired to secure a plurality of objects together and/or to inhibit relative movement between a first object and a second object.

The design of the securing device 10 can be varied. In certain embodiments, as shown in FIG. 1, the securing device 10 includes a device body 12 that is configured to provide various advantages, as noted herein, over generally available securing devices. For example, as provided herein, the securing device 10 and/or the device body 12 can be formed from material(s) having desired elasticity (e.g., elongation), strength (e.g., tensile strength), and friction characteristics, and can be formed to a desired body thickness and body width to provide the various advantages noted herein. However, it is appreciated that the size, e.g., the body thickness and the body width, of the securing device 10 and/or the device body 12 can be varied to provide the desired elasticity, strength and friction characteristics depending on the particular intended uses for the securing device 10. Further, in various embodiments, as provided herein, the materials used for forming the securing device 10 are such that the securing device 10 is reusable and/or recyclable as desired. Still further, the material(s) utilized for the securing device 10 can be provided in a homogeneous manner (e.g., without separate layers or sections of material that are bonded together), and the securing device is fully operable without the need for any specific adhesive material that is coupled and/or secured to the device body 12.

The specific material utilized for the securing device 10 and/or the device body 12 can be varied, but is generally intended to comply with various specifications, features and attributes as provided herein. For example, in various embodiments, the securing device 10 and/or the device body 12 can be formed from one or more materials including polypropylene, styrene-butadiene-styrene (SBS), styrene-ethylene-butylene-styrene (SEBS, also sometimes referred to as Type "S" TPE (TPE plus styrene), calcium carbonate, and rubber softening oil. More specifically, in some embodiments, the securing device 10 and/or the device body 12 can be formed from thermoplastic elastomers (or thermoplastic rubbers, and also referred to generally as "TPE"). One such example is the Type "S" TPE material, which is formed from synthetic block copolymers. Alternatively, in other embodiments, the securing device 10 and/or the device body 12 can be formed from and/or include natural rubber. Still alternatively, in still other embodiments, the securing device 10 and/or the device body 12 can be formed from and/or include polyisobutylene (also sometimes referred to as "butyl rubber"). Such material is a synthetic rubber that is a copolymer of isobutylene and isoprene. Yet alternatively, the securing device 10 and/or the device body 12 can be formed from one or more other suitable materials, and/or any combination of materials as referred to herein.

It is appreciated that the securing device 10 and/or the device body 12 can have any suitable size, e.g., dimensions such as a body thickness, a body width and a body length (i.e, measured from a first end 12A to an opposed second end 12B), and shape. For example, in certain embodiments, the securing device 10 and/or the device body 12 can have a substantially rectangular-shaped cross-section which can be cut to any desired body length. Alternatively, the securing device 10 and/or the device body 12 can have another suitable cross-sectional shape.

Figure 2A:
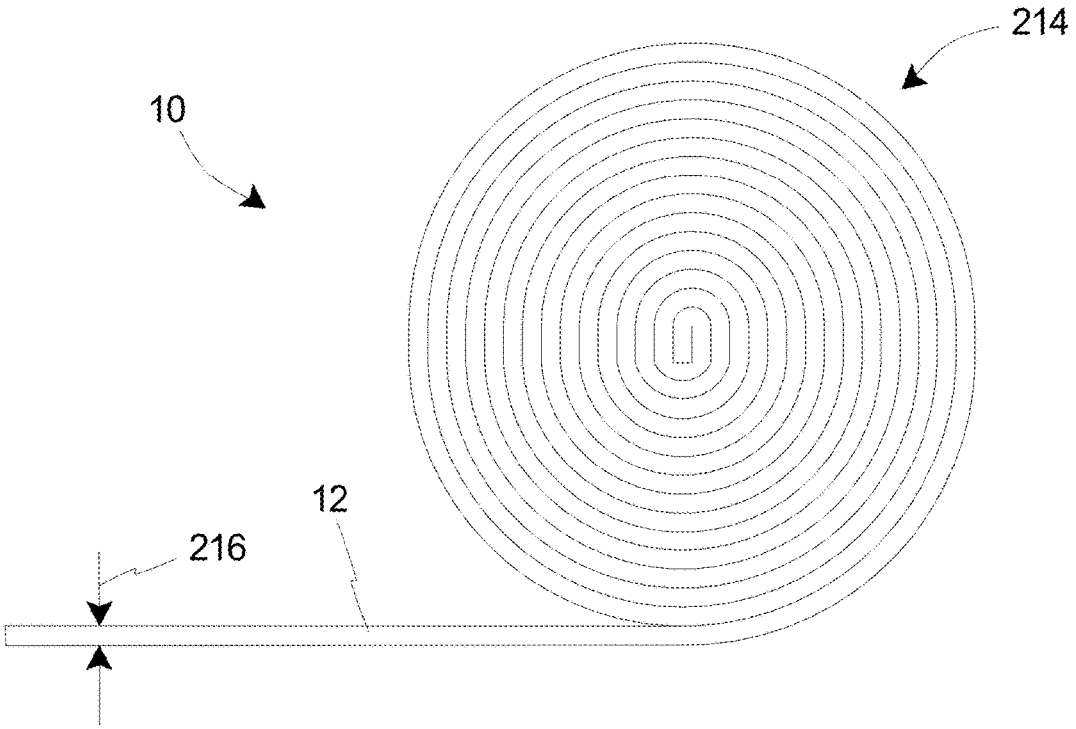
FIG. 2A is a simplified schematic side view illustration of an embodiment of a material roll from which the securing device illustrated in FIG. 1 can be obtained.
Figure 2B:
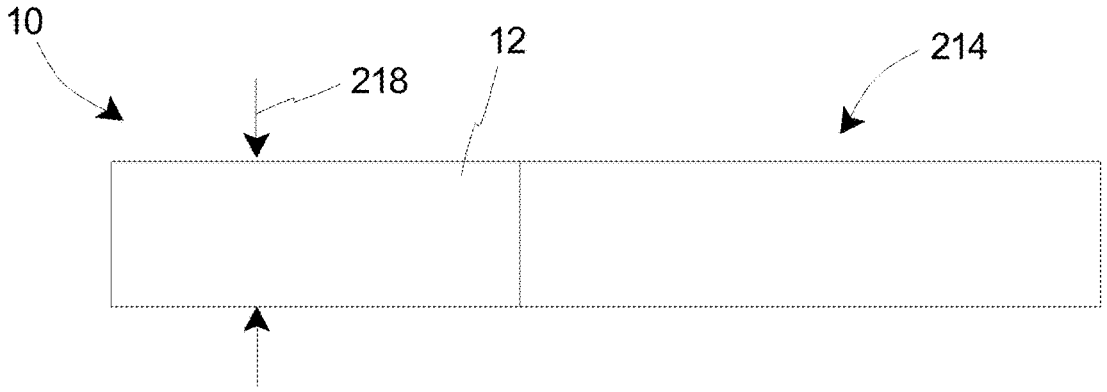
FIG. 2B is a simplified schematic top view illustration of the material roll illustrated in FIG. 2A.

In order for the securing device 10 to be provided in various alternative desired lengths, in some embodiments, the product can initially be provided in the form of a material roll from which the securing device 10 can be obtained. For example, FIG. 2A is a simplified schematic side view illustration of an embodiment of a material roll 214 from which the securing device 10 illustrated in FIG. 1 can be obtained. More particularly, the securing device 10 can be cut in any desired length from the material roll 214 so as to be usable for any desired securing tasks. Additionally, FIG. 2B is a simplified schematic top view illustration of the material roll 214 illustrated in FIG. 2A. As shown, FIG. 2A and FIG. 2B illustrate certain additional features of the securing device 10 and/or the device body 12, e.g., certain dimensions of the securing device 10 and/or the device body 12.

The dimensions of the securing device 10 and/or the device body 12 can be varied to suit the particular intended uses of the securing device 10. Additionally, it is appreciated that the specific dimensions of the securing device 10 and/or the device body 12 can be selected to provide a desired combination of elasticity and strength. For example, as illustrated in FIG. 2A, the device body 12 can be configured to have a certain body thickness 216. In certain non-exclusive embodiments, the device body 12 can have a body thickness 216 of between approximately one millimeter and four millimeters. More specifically, in one non-exclusive embodiment, e.g., for a thick strap, the device body 12 can have a body thickness 216 of approximately three millimeters. In another non-exclusive embodiment, e.g., for a thin strap, the device body 12 can have a body thickness 216 of approximately two millimeters. In still another non-exclusive embodiment, e.g., for an extra thin strap, the device body 12 can have a body thickness 216 of approximately one millimeter. In yet another non-exclusive embodiment, e.g., for an extra thick strap, the device body 12 can have a body thickness of approximately four millimeters. Alternatively, the device body 12 can have a body thickness 216 that is greater than four millimeters or less than one millimeter.

In various embodiments, it is appreciated that if the device body 12 is designed with a body thickness 216 that is too large (i.e. the device body 12 is too thick), then the securing device 10 will lose some of its desired elasticity. Conversely, if the device body 12 is designed with a body thickness 216 that is too small (i.e. the device body 12 is too thin), then the securing device 10 will lose some of its desired strength. It is appreciated, however, that depending upon the specific material being used, the body thickness 216 of the device body 12 can be greater than four millimeters or less than one millimeter.

Additionally, as illustrated in FIG. 2B, the device body 12 can also be configured to have a certain body width 218 to also provide the desired combination of elasticity and strength. In some non-exclusive embodiments, the device body 12 can have a body width 218 of between approximately thirty millimeters and fifty millimeters. Such a range for the body width 16 has been found to provide the desired elasticity and strength properties. In certain such embodiments, the device body 12 can have a body width 218 of approximately forty millimeters. It is appreciated, however, that depending upon the specific material being used, the body width 218 of the device body 12 may be greater than fifty millimeters or less than thirty millimeters.

Thus, with the noted ranges for the body width 218 and the body thickness 216, in various embodiments, the device body 12 can have a body width to body thickness ratio of between approximately 7.5:1 and 50:1. For example, in certain non-exclusive alternative embodiments, the device body 12 can have a body width to body thickness ratio of approximately 7.5:1, 10:1, 15:1, 20:1, 25:1, 30:1, 35:1, 40:1, 45:1 or 50:1. Alternatively, in other embodiments, the device body 12 can have a body width to thickness ratio that is greater than 50:1 or less than 7.5:1.

Additionally, the securing device 10 and/or the device body 12 can have any suitable cross-sectional area (i.e. calculated as the body thickness 216 times the body width 218). For example, in certain embodiments, with the noted ranges for the body thickness 216 and the body width 218, the device body 12 can have a cross-sectional area of between approximately thirty square millimeters and two hundred square millimeters. More particularly, for an embodiment having a body thickness 216 of approximately one millimeter and a body width 218 of approximately thirty millimeters, the device body 12 will have a cross-sectional area of approximately thirty square millimeters; and for an embodiment having a body thickness 216 of approximately four millimeters and a body width 218 of approximately fifty millimeters, the device body 12 will have a cross-sectional area of approximately two hundred square millimeters. In one non-exclusive alternative embodiment, i.e. a thin strap, the device body 12 can have a body thickness 216 of approximately two millimeters, a body width 218 of approximately forty millimeters, and a cross-sectional area of approximately eighty square millimeters. In another non-exclusive alternative embodiment, i.e. a thick strap, the device body 12 can have a body thickness 216 of approximately three millimeters, a body width 218 of approximately forty millimeters, and a cross-sectional area of approximately one hundred twenty square millimeters.

Further, the material roll 214 can be configured to have any suitable body length to suit the intended uses of the securing device 10. For example, in certain non-exclusive embodiments, it can be desired that the body length of the material roll 214 be at least approximately six meters. Such body length enables the user to have a long length securing device 10 when desired, while also allowing the user to cut smaller segments from the material roll 214 when the intended use necessitates only a smaller length for the securing device 10. Alternatively, the material roll 214 can have any suitable body length, which can be greater than or less than six meters.

As provided herein, in selecting appropriate material(s) for the securing device 10 and/or the device body 12, it is desired that the material(s) is able to exhibit or possesses certain properties, e.g., properties of elasticity (or elongation), strength (e.g., tensile strength), and friction, when utilized in the form of the securing device 10 and/or the device body 12.

For example, it is desired that the selected material possess certain properties of elasticity (or elongation) when utilized in the form of the securing device 10 and/or the device body 12. More particularly, in certain embodiments, the selected material in such form can exhibit properties of elongation that are between approximately six hundred percent and eight hundred percent. The elongation of the material enables the securing device 10 to be readily stretched about the objects being secured, while still maintaining the desired and necessary strength characteristics so as to not fail under stress. Alternatively, in other embodiments, the elongation of the selected material in such form can be greater than eight hundred percent or less than six hundred percent.

It is appreciated that the elongation of the material is also a factor of the cross-sectional area of the device body 12. For example, in one non-exclusive embodiment, e.g., a thin strap that is 2.0 mm by 40.0 mm, the material showed elongation properties of between approximately 655% and 768% (with an average elongation of 710%). In another non-exclusive embodiment, e.g., a thick strap that is 3.0 mm by 40.0 mm, the material showed elongation properties of between approximately 633% and 779% (with an average elongation of 707%).

Additionally, it is further appreciated that the elongation of the material and/or the elongation of the securing device 10 and/or the device body 12 can also be evaluated in terms of a ratio of the elongation (in percent) to the cross-sectional area of the device body 12 (in square millimeters). For example, in various embodiments, the ratio of elongation (in percent) to cross-sectional area (in square millimeters) can be between approximately 3:1 and 30:1. More specifically, in such embodiments, the ratio of elongation to cross-sectional area can be approximately 2:1, 3:1, 4:1, 5:1, 6:1, 7:1, 8:1, 10:1, 12:1, 15:1, 20:1, 25:1 or 30:1. In one non-exclusive embodiment, e.g., a thin strap that is 2.0 mm by 40.0 mm, the ratio of elongation to cross-sectional area can be between approximately 8:1 and 10:1. In another non-exclusive embodiment, e.g., a thick strap that is 3.0 mm by 40.0 mm, the ratio of elongation to cross-sectional area can be between approximately 5:1 and 7:1. Alternatively, the ratio of elongation to cross-sectional area can be different than the specific values noted herein, i.e. can be greater than approximately 30:1 or less than approximately 3:1.

As noted, it is further desired that the selected material possess certain properties of strength depending upon the intended use for the securing device 10. In particular, in certain embodiments, it can be desired that the selected material possess a certain tensile strength when utilized in the form of the securing device 10 and/or the device body 12. More specifically, in such embodiments, the selected material can exhibit properties of tensile strength in such form of between approximately four thousand five hundred kilopascals (kPa) and approximately nine thousand three hundred kPa (and/or of between approximately six hundred fifty pounds per square inch (psi) and approximately one thousand three hundred fifty psi). The tensile strength of the material enables the securing device 10 to exhibit greater securing capabilities without failure as the securing device 10 is being readily stretched about the objects being secured. Alternatively, in other embodiments, the tensile strength of the material in such form can be greater than nine thousand three hundred kPa or less than four thousand five hundred kPa (and/or greater than one thousand three hundred fifty psi or less than six hundred fifty psi).

It is appreciated that the tensile strength of the material is impacted by the cross-sectional area of the device body 12. For example, in one non-exclusive embodiment, e.g., a thin strap that is 2.0 mm by 40.0 mm, the material showed tensile strength of between approximately six hundred fifty psi and nine hundred fifty psi (with an average tensile strength of approximately eight hundred) (and/or between approximately four thousand five hundred kPa and six thousand five hundred fifty kPa). In another non-exclusive embodiment, e.g., a thick strap that is 3.0 mm by 40.0 mm, the material showed tensile strength of between approximately nine hundred fifty psi and one thousand three hundred fifty psi (with an average tensile strength of approximately one thousand one hundred psi) (and/or between approximately six thousand five hundred fifty kPa and nine thousand three hundred kPa).

Additionally, it is further appreciated that the tensile strength of the material and/or the tensile strength of the securing device 10 and/or the securing body 12 can also be evaluated in terms of a ratio of tensile strength (in kPa) to the cross-sectional area of the device body 12 (in square millimeters). For example, in various embodiments, the ratio of tensile strength (in kPa) to cross-sectional area (in square millimeters) can be between approximately 50:1 and 85:1. More specifically, in such embodiments, the ratio of tensile strength to cross-sectional area can be approximately 40:1, 50:1, 55:1, 60:1, 65:1, 70:1, 75:1, 80:1, 85:1 or 100:1. Alternatively, the ratio of tensile strength to cross-sectional area can be different than the specific values noted herein, i.e. can be greater than approximately 100:1 or less than approximately 40:1.

Further, as noted, it is also desired that the selected material possess certain properties of friction. As described herein, during use of the securing device 10, a portion of the device body 12 may be wrapped around itself in addition to be wrapped around the objects being secured. Thus, it is desired that the material has sufficient frictional properties that will enable the material to maintain its position relative to itself (i.e. in the wrappings around itself), as well as maintaining its position relative to the objects being secured. For example, in certain non-exclusive embodiments, the material can exhibit an average kinetic coefficient of friction relative to itself (i.e. device body 12 on device body 12) of between approximately 1.35 and 1.60. Additionally, in such embodiments, the material can exhibit an average kinetic coefficient of friction relative to steel (i.e. device body 12 on steel) of between approximately 1.25 and 1.50). Further, in such embodiments, the material can exhibit an average kinetic coefficient of friction relative to wood (i.e. device body 12 on wood) of between approximately 0.65 and 0.90. Alternatively, the material can exhibit frictional qualities that are different than, i.e. greater than or less than, those specified herein above.

In other non-exclusive embodiments, the material can exhibit an average coefficient of static friction relative to itself (i.e. device body 12 on device body 12) of greater than 0.75 and less than 1.75. Additionally, in such embodiments, the material can exhibit an average coefficient of static friction relative to steel (i.e. device body 12 on steel) of greater than 1.00 and less than 2.00. Further, in such embodiments, the material can exhibit an average coefficient of static friction relative to wood (i.e. device body 12 on wood) of greater than 0.30 and less than 1.30. Alternatively, the material can exhibit frictional qualities that are different than, i.e. greater than or less than those specified herein above.

In order to achieve these ranges of average coefficients of static friction, the securing device 10 and/or the device body 12 can be formed from one or more materials including polypropylene, styrene-butadiene-styrene (SBS), styrene-ethylene-butylene-styrene (SEBS, also sometimes referred to as Type "S" TPE (TPE plus styrene), thermoplastic elastomers (or thermoplastic rubbers, and also referred to generally as "TPE"), synthetic block copolymers, polyisobutylene (also sometimes referred to as "butyl rubber"), calcium carbonate, natural rubber and rubber softening oil.

In various embodiments, the material described herein can have a coefficient of static fiction greater than or equal to 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.00, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2.00, 2.05, 2.10, 2.15, 2.20, 2.25, 2.30, 2.35, 2.40, 2.45, 2.50, 2.55, 2.60, 2.65, 2.70, 2.75, 2.80, 2.85, 2.90, 2.95, 3.00, 3.05, 3.10, 3.15, 3.20, 3.25, 3.30, 3.35, 3.40, 3.45, 3.50, 3.55, 3.60, 3.65, 3.70, 3.80, 3.85, 3.90, 3.95 or 4.00. It is appreciated that the material illustrated and/or described herein can have a coefficient of static fiction that can falls within a range, wherein any of the foregoing numbers can serve as the lower or upper bound of the range, provided that the lower bound of the range is a value less than the upper bound of the range. The material illustrated and/or described herein can have a coefficient of static fiction that falls outside of the range described herein.

As described herein, it is appreciated that the various specifications for the selected material can vary depending on the size and shape of the securing device 10 and/or the device body 12. For example, as noted, it is appreciated that one or more of the elongation, the tensile strength, average coefficient of static friction and/or the average kinetic coefficient of friction of the selected material can vary depending upon the body thickness 216 and the body width 218 of the securing device 10 and/or the device body 12.

Additionally, the securing device 10 and/or the device body 12 can be designed to be any of various possible colors. For example, in certain non-exclusive embodiments, the securing device 10 and/or the device body 12 can be provided in colors such as black, red, blue, green and yellow. Alternatively, the securing device 10 and/or the device body 12 can be provided in other desired colors.

Figure 3A:
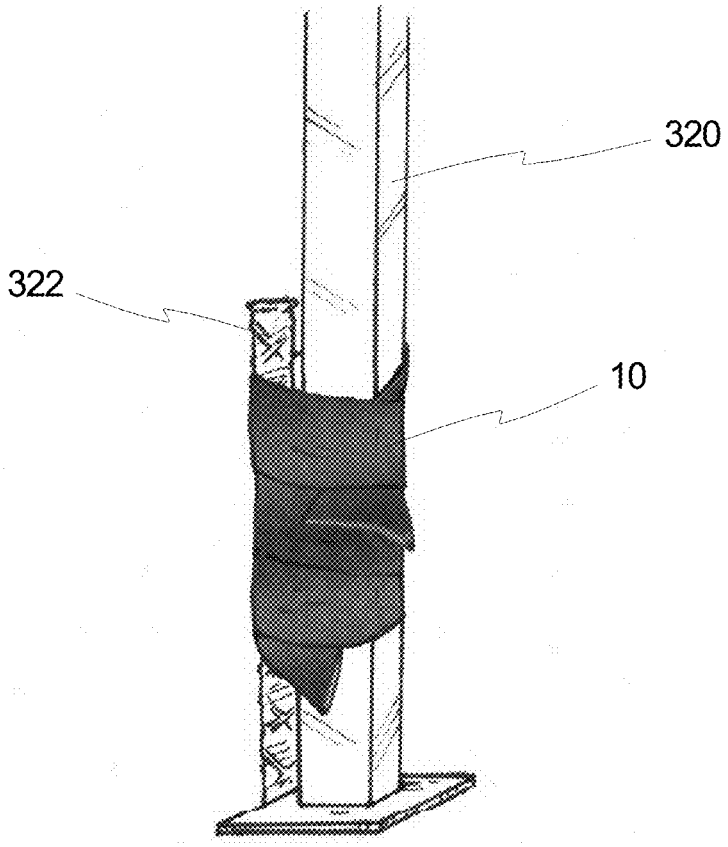
FIG. 3A is a simplified schematic perspective view illustration of one representative use of the securing device illustrated in FIG. 1 to inhibit relative movement between a first object and a second object.

FIG. 3A is a simplified schematic perspective view illustration of one representative use of the securing device 10 illustrated in FIG. 1 secure a first object 320 relative to a second object 322, i.e. to inhibit relative movement between the first object 320 and the second object 322. In particular, FIG. 3A illustrates the securing device 10 being utilized to inhibit relative movement between the first object 320, e.g., a tent pole, and the second object 322, e.g., a stake, which can be secured within the ground. As shown, with the securing device 10 wrapped around both the tent pole 320 and the stake 322, and tucked in on either end of the securing device 10, the tent pole 320 is secured relative to the stake 322, and/or is inhibited from moving relative to the stake 322.

Figure 3B:
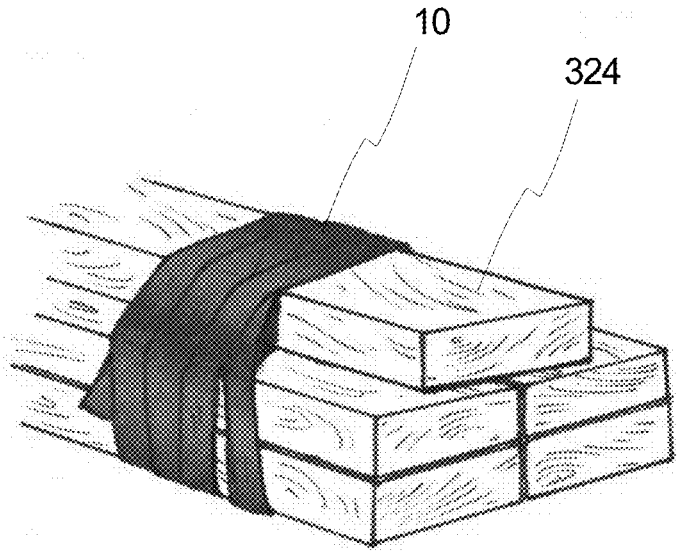
FIG. 3B is a simplified schematic perspective view illustration of another representative use of the securing device illustrated in FIG. 1 to secure a plurality of objects together.

FIG. 3B is a simplified schematic perspective view illustration of another representative use of the securing device 10 illustrated in FIG. 1 to secure a plurality of objects 324 together. In particular, FIG. 3B illustrates the securing device 10 being utilized to secure the plurality of objects 324, i.e. the pieces of lumber, together, so that the objects 324 can be easily moved together from one place to another or stored together in a single location. As shown, with the securing device 10 wrapped around the plurality of pieces of lumber 324, and tucked in on either end of the securing device 10, the pieces of lumber 324 can be easily maintained in position together with one another. It is appreciated that in the simplest form of this particular use for the securing device 10, the securing device 10 is simply used to secure two objects 324 together, e.g., to simply secure a first object 324 relative to a second object 324.

Figure 4:
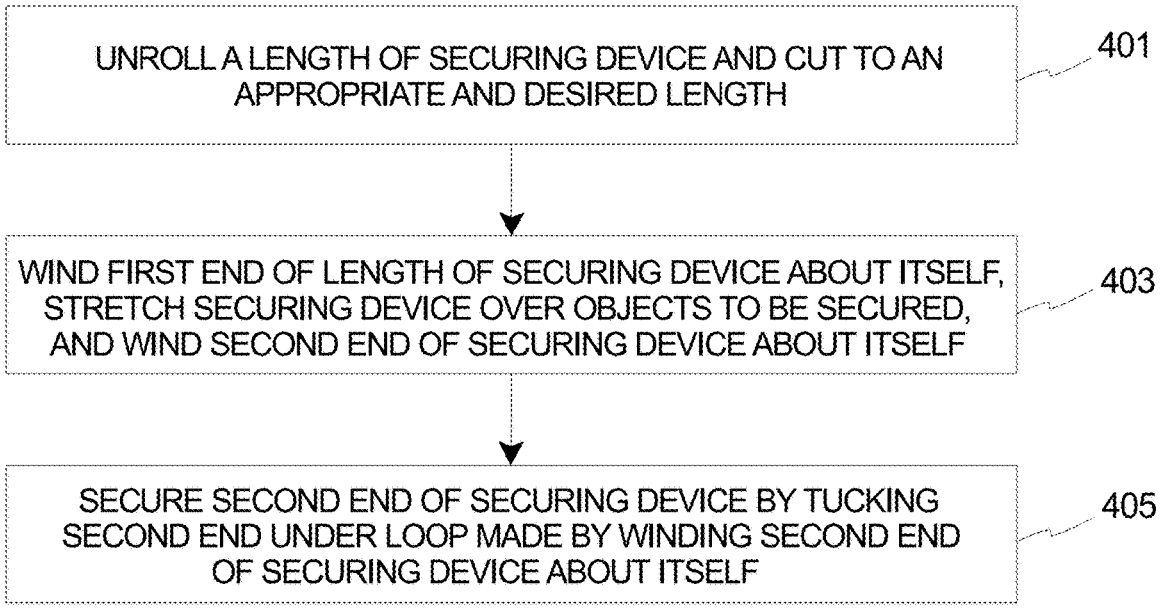
FIG. 4 is a flowchart that describes one representative example of a method for installation of the securing device.
Figure 5:
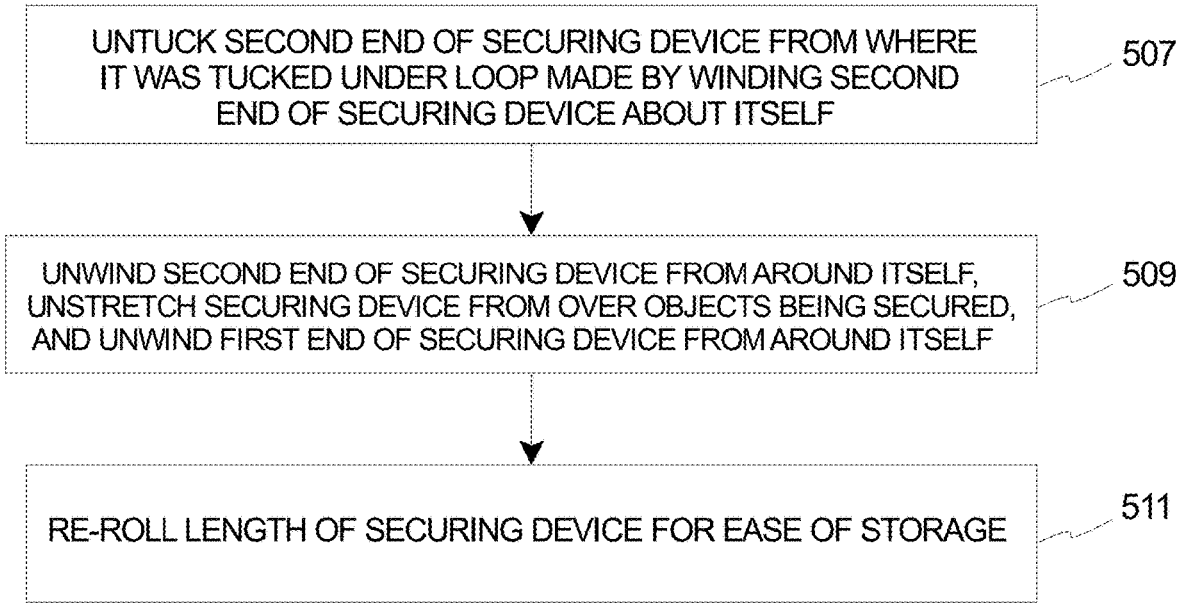
FIG. 5 is a flowchart that described one representative example of a method for removal of the securing device.

FIGS. 4 and 5 are flowcharts that illustrate potential methods of use of the securing device. It is appreciated that the order and/or sequence illustrated and described herein for these methods are not necessarily indicative of how the securing device is used chronologically, as one or more of the steps can be combined, reordered, repeated and/or performed simultaneously without deviating from the intended breadth and scope of the present invention.

FIG. 4 is a flowchart that describes one representative example of an installation of the securing device, i.e. for purposes of securing a first object relative to a second object.

At step 401, a user can unroll a length of the securing device and/or device body. The user can then cut an appropriate and desired length from the device body depending on the intended use.

At step 403, the user can wind a first end of the length of the securing device and/or device body about itself as well as about a first object to be secured. The user can then stretch the length of the securing device and/or the device body over or about all of the objects that are to be secured. The user then winds a second end of the length of the securing device and/or device body about itself as well as about one of the objects to be secured.

At step 405, the user secures the second end of the length of the securing device and/or device body by tucking the second end under a loop that was formed by winding the second end of the length of the securing device and/or device body about itself. At this point, the objects have been effectively secured relative to one another so as to inhibit relative movement between the objects. It is appreciated that with the high coefficient of friction characteristics of the securing device, the securing device is effectively self-gripping, so there is no need to tie knots at the ends or use additional parts such as hooks, clamps or other extraneous parts, to maintain the desired positioning of the securing device. As used herein, the term "self-gripping" is intended to mean that one portion of the securing device can effectively grip or otherwise hold on to any other portion of the securing device by virtue of the materials used and the relatively high coefficient of friction of the securing device, and without the need for additional parts that would otherwise be attached to the securing device.

FIG. 5 is a flowchart that described one representative example of a removal of the securing device.

At step 507, the user untucks the second end of the length of the securing device and/or device body from where it was tucked under the loop that was formed by winding the second end of the length of the securing device and/or device body about itself.

At step 509, the user unwinds the second end of the length of the securing device and/or device body from around itself and from around the object around which it was wound. The user can then unstretch the length of the securing device and/or device body from over all of the objects that were being secured. The user then unwinds the first end of the length of the securing device and/or device body from around itself and from around the first object. The securing device and/or device body can thus be removed from the objects.

At step 511, the user can re-roll the length of the securing device and/or device body so that the length of the securing device and/or device body can be easily put away for storage and potential reuse.

The noted processes for using and removing the securing device is fast and easy to perform and equally fast and easy to undo, yet provides a tie-down or binding effect, i.e. a securing device, at least as secure as rope, bungee cords or nylon straps, but much easier and more convenient to use for various alternative securing processes.

It is understood that although a number of different embodiments of the securing device have been illustrated and described herein, one or more features of any one embodiment can be combined with one or more features of one or more of the other embodiments, provided that such combination satisfies the intent of the present invention.

While a number of exemplary aspects and embodiments of the securing device have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A securing device for securing a first object relative to a second object, the securing device being configured to frictionally maintain its position relative to the objects and to itself, the securing device comprising:

a device body having a first end, an opposed second end, and a cross-sectional area, the device body being formed from a material so that the device body exhibits elongation of greater than six hundred percent and less than eight hundred percent, the material that forms the device body having an average coefficient of static friction of greater than 0.75 and less than 1.75 relative to itself;

wherein a ratio of the elongation (in percent) to the cross-sectional area (in square millimeters) is greater than 2:1 and less than 30:1.

2. The securing device of claim 1 wherein the cross-sectional area of the device body is greater than thirty square millimeters and less than two hundred square millimeters.

3. The securing device of claim 1 wherein the cross-sectional area of the device body is greater than eighty square millimeters and less than one hundred twenty square millimeters.

4. The securing device of claim 1 wherein the device body has a body thickness of greater than one millimeter and less than four millimeters.

5. The securing device of claim 4 wherein the device body has a body width of greater than thirty millimeters and less than fifty millimeters.

6. The securing device of claim 1 wherein the device body is formed from the material so that the device body exhibits tensile strength of greater than four thousand five hundred kPa and less than nine thousand three hundred kPa, and wherein a ratio of the tensile strength (in kPa) to the cross-sectional area (in square millimeters) is greater than 50:1 and less than 85:1.

7. The securing device of claim 1 wherein the material that forms the device body includes thermoplastic elastomers.

8. The securing device of claim 7 wherein the material that forms the device body includes styrene.

9. The securing device of claim 1 wherein the cross-sectional area of the device body is substantially rectangular-shaped.

* * * * *